US008381538B2

(12) United States Patent
Lifson et al.

(10) Patent No.: US 8,381,538 B2
(45) Date of Patent: Feb. 26, 2013

(54) HEAT PUMP WITH INTERCOOLER

(75) Inventors: Alexander Lifson, Manlius, NY (US); Michael F. Taras, Fayetteville, NY (US)

(73) Assignee: Carrier Corporation, Syracuse, NY (US)

( * ) Notice: Subject to any disclaimer, the term of this patent is extended or adjusted under 35 U.S.C. 154(b) by 870 days.

(21) Appl. No.: 12/442,758

(22) PCT Filed: Nov. 8, 2006

(86) PCT No.: PCT/US2006/043746

§ 371 (c)(1),
(2), (4) Date: Mar. 25, 2009

(87) PCT Pub. No.: WO2008/057090

PCT Pub. Date: May 15, 2008

(65) Prior Publication Data

US 2010/0032133 A1 Feb. 11, 2010

(51) Int. Cl.
*F25B 1/00* (2006.01)

(52) U.S. Cl. ..... 62/115; 62/513

(58) Field of Classification Search ..... 62/324.1, 62/324.6, 510, 513, 228.3, 506, 115; 165/62, 165/201

See application file for complete search history.

(56) References Cited

U.S. PATENT DOCUMENTS 4,313,309 A 2/1982 Lehman, Jr.
4,332,137 A * 6/1982 Hayes, Jr. ..... 62/81
4,774,813 A * 10/1988 Yokoyama ..... 62/81
5,095,712 A 3/1992 Narreau
5,103,650 A * 4/1992 Jaster ..... 62/198
6,032,472 A 3/2000 Heinrichs et al.
6,658,888 B2 12/2003 Manohar et al.
6,698,234 B2 3/2004 Gopalnarayanan et al.
6,941,770 B1 * 9/2005 Taras et al. ..... 62/512
7,231,774 B2 * 6/2007 Taras et al. ..... 62/176.5
2003/0192338 A1 * 10/2003 Manohar et al. ..... 62/498

OTHER PUBLICATIONS

International Preliminary Report on Patentability dated May 22, 2009.

Search Report and Written Opinion mailed on Apr. 10, 2007 for PCT/US2006/43746.

* cited by examiner

*Primary Examiner* — Mohammad Ali
(74) *Attorney, Agent, or Firm* — Carlson, Gaskey & Olds

(57) ABSTRACT

A heat pump refrigerant system is provided with at least two sequential stages of compression. An intercooler is positioned intermediate the two stages. The refrigerant flowing through the intercooler. is cooled by a secondary fluid such as ambient air. The intercooler is positioned to be in a path of air flow passing over an outdoor heat exchanger, and preferably upstream of the outdoor heat exchanger, in relation to this air flow. Benefits with regard to efficiency and capacity are achieved due to proposed system configuration in both heating and cooling modes of operation, while no additional circuitry or components are required to provide the intercooler function for the heat pump refrigerant system. This invention is particularly important for the $CO_2$ heat pump refrigerant systems operating in the transcritical cycle.

20 Claims, 1 Drawing Sheet

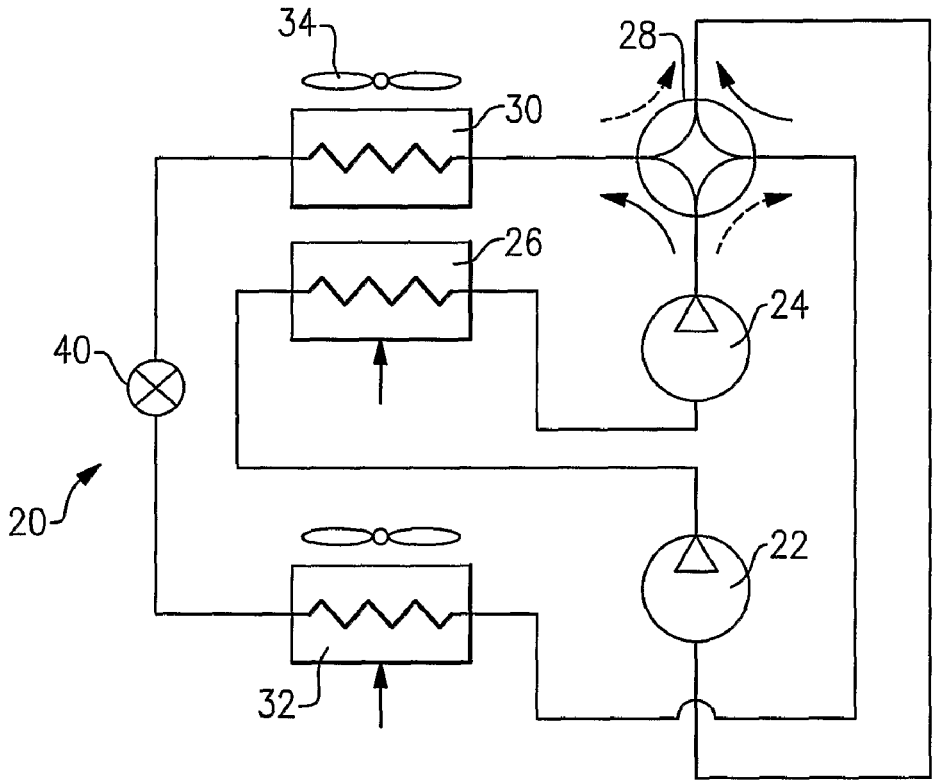
34
28
30
26
24
40
20
22
32

HEAT PUMP WITH INTERCOOLER

BACKGROUND OF THE INVENTION

This application relates to a heat pump refrigerant system, wherein the compressor is a two-stage compressor, and wherein an intercooler is provided between the two compression stages. The intercooler is preferably subjected to the ambient airflow and is placed upstream of an outdoor heat exchanger with, respect to this ambient airflow, such that the cooling in the intercooler is preferably provided by the circuitry and components that are already part of the refrigerant system.

Heat pumps are known in the air conditioning art, and are utilized to provide both heating and cooling of a secondary fluid, such as air, delivered into an environment to be conditioned. A typical heat pump includes a compressor, an expansion device, an outdoor heat exchanger and an indoor heat exchanger. Typically, a four-way valve reverses the flow of refrigerant throughout the system between a cooling and heating mode of operation. The refrigerant flows from the compressor to the outdoor heat exchanger when the refrigerant system is in a cooling mode, and from the compressor to the indoor heat exchanger when the refrigerant system is in a heating mode.

To obtain additional capacity, enhance system efficiency and achieve higher compression ratios, it is often the case that a two-stage compressor is provided in a refrigerant system. With a two-stage compressor, two separate compression members or two separate compressor units are disposed in series in a refrigerant system. Specifically, for instance, in case of a reciprocating compressor, two separate compression members may be represented by different banks of cylinders connected in series. Refrigerant compressed by a lower stage to an intermediate pressure is delivered from a discharge outlet of this lower stage to the suction inlet of the higher stage. If the compression ratio for the compressor system is high (which is typically the case for two-stage compression systems) and/or refrigerant suction temperature is high (which is often the case for a refrigerant system equipped with liquid-suction heat exchanger), then refrigerant discharge temperature can also become extremely high, and in many cases may exceed the limit defined by the safety or reliability considerations. Thus, it is known in the art to provide an intercooler heat exchanger (or a so-called intercooler) between the two compression stages to extend the operational envelope and/or improve system reliability. In an intercooler, refrigerant flowing between the two compression stages is typically cooled by a secondary fluid. Quite often, additional components and circuitry are required to provide cooling of the refrigerant in the intercooler. As an example, a fan or pump is supplied to move a secondary cooling fluid from a cold temperature source to cool the refrigerant in the intercooler.

Recently, new generation refrigerants, such as natural refrigerants, are being utilized in refrigerant systems. One very promising refrigerant is carbon dioxide (also known as $CO_2$ or R744). However, particularly with the $CO_2$ refrigerant systems, the intercooler becomes even more important as these systems tend to operate at high discharge temperatures due to high operating pressures, frequent use of liquid-suction heat exchanger, and, in general, by the transcritical nature of the $CO_2$ cycle, as well as a high value of the polytropic compression exponent for the $CO_2$ refrigerant. However, the additional cost of the circuitry and components associated with the intercooler, along with the limited benefits for the prior art refrigerant systems utilizing conventional refrigerants, made the provision of an intercooler in the conventional refrigerant systems less desirable.

Thus, it is desirable to provide an intercooler for a multi-stage compressor refrigerant system, and particularly for a $CO_2$ heat pump refrigerant system, that essentially does not require any additional circuitry or components beyond the intercooler itself.

SUMMARY OF THE INVENTION

In a disclosed embodiment of this invention, a heat pump refrigerant system incorporates a multi-stage compressor. An intercooler is provided between at least two of the compression stages connected in series. The intercooler is positioned to be subjected to an airflow passing over an outdoor heat exchanger. Preferably, an intercooler is positioned upstream of the outdoor heat exchanger, with respect to the ambient airflow.

In this invention, when the system is operating in the cooling mode, an outdoor fan that passes air over the outdoor heat exchanger (a so-called condenser in a subcritical cycle and a so-called gas cooler in a transcritical cycle) also cools the intercooler. When the system is operating in the heating mode, the refrigerant flow throughout the refrigerant system is reversed, and the outdoor heat exchanger becomes an evaporator. Therefore, the same outdoor fan cools the intercooler but now in conjunction with the air stream passing over the evaporator. In this case, when the system is operating in the heating mode, the capacity and efficiency of the heating cycle are increased, as the mass flow through the compressor is raised due to additional pre-heating of the air stream passing over the outdoor heat exchanger (an evaporator, in this case) by the heat rejected by the intercooler. At the same time the inter-stage refrigerant temperature is reduced as the cold ambient air cools the refrigerant flowing from a lower compression stage to a higher compression stage.

When the system is operating in the cooling mode, the intercooler also increases system capacity and improves efficiency, since the compressor discharge temperature is reduced, and the outdoor heat exchanger (a condenser or a gas cooler, in this case) will be capable to cool refrigerant to a lower temperature, providing a higher cooling potential in the evaporator.

Additionally, if the system operates in a transcritical cycle, where the high side temperature and pressure are independent from each other, the discharge pressure is not limited by a discharge temperature anymore and can be adjusted to the value providing an optimum performance level. Thus, efficiency and capacity in both cooling and heating modes of operation are enhanced.

These and other features of the present invention can be best understood from the following specification and drawings, the following of which is a brief description.

BRIEF DESCRIPTION OF THE DRAWINGS

The sole drawing shows a schematic of an inventive heat pump refrigerant system.

DETAILED DESCRIPTION OF THE PREFERRED EMBODIMENTS

A refrigerant system 20 is illustrated in FIG. 1 having a lower stage compressor 22 and a higher stage compressor 24. While only two sequential stages are shown, additional stages may also be incorporated in series in this invention. Also, instead of separate compressors connected in sequence, a multi-stage compressor arrangement can be employed and equally benefit from the present invention. For instance, two separate compression members may be represented by different banks of cylinders connected in series for a reciprocating compressor. As known, refrigerant compressed by a lower stage to an intermediate pressure is delivered from a discharge outlet of this lower stage to the suction inlet of the higher stage. An intercooler 26 is positioned between the two stages to accept refrigerant from a discharge outlet of the lower stage 22, cool it by a secondary media, such as ambient air blowing over external heat transfer surface of the intercooler 26 during heat transfer interaction with the refrigerant, and deliver it downstream to a suction inlet of the higher stage 24. Again, if additional stages of compression are provided, additional intercoolers may also be positioned between those stages.

The refrigerant system 20 is a heat pump. Thus, a switch, such as four-way valve 28, alternatively routes refrigerant from the discharge outlet of the higher compression stage 24 either to an outdoor heat exchanger 30, when the refrigerant system 20 in a cooling mode, or to an indoor heat exchanger 32, when the refrigerant system 20 is in a heating mode.

A fan or other air-moving device 34 moves air over the outdoor heat exchanger 30. The intercooler 26 is positioned adjacent to the outdoor heat exchanger 30, and preferably upstream of the heat exchanger 30, in relation to the airflow, and such that the fan 34 also moves air over the intercooler 26. Thus, the air stream will be preheated by the intercooler 26 before reaching the outdoor heat exchanger 30. At the same time, during heat transfer interaction between the air and refrigerant in the intercooler 26, the temperature of the refrigerant flowing through the intercooler 26 is reduced. As also known, other secondary media such as water or glycol can be used instead of air, and consequently, the fan 34 can be replaced by a liquid pump.

As is also known, an expansion device 40 is positioned between the two heat exchangers 30 and 32.

When the refrigerant system 20 is operating in a heating mode, the air stream driven by the fan 34 will cool refrigerant flowing through the intercooler. The outdoor heat exchanger 30 provides an evaporator function in the heating mode of operation. When the refrigerant system 20 is in the heating mode, the capacity and efficiency of the heating cycle of the present invention are increased (in comparison to a conventional heating cycle), as the refrigerant mass flow through the compressor is raised due to the additional pre-heating of the air stream passing over the evaporator 30 by the heat rejected into the air by the intercooler 26.

The increase in the refrigerant mass flow passing through the compressors 22 and 24 is mainly a result of increased pressure in the evaporator 30 due to higher temperature of the refrigerant flowing through the evaporator 30. As the refrigerant pressure is increased its density is also increased. Thus, with the compressor (typical of these installations) being an approximately constant volumetric displacement machine, the mass flow of refrigerant would generally follow the refrigerant pressure in the evaporator.

When the refrigerant system 20 is operating in the cooling mode, the intercooler 26 increases system capacity and efficiency, since the compressor discharge temperature is reduced and the outdoor heat exchanger 30 (a condenser or a gas cooler, in this case) will be capable to cool refrigerant to a lower temperature, providing a higher cooling potential for the refrigerant entering the evaporator 32. The compressor power is also reduced as heat is removed from the compression process and the outdoor heat exchanger pressure is reduced. Additionally, if the refrigerant system 20 operates in a transcritical cycle, where the high side temperature and pressure are independent from each other, the discharge pressure is not limited by a discharge temperature anymore and can be adjusted to a value corresponding to an optimum performance level. Additionally, in both subcritical and transcritical cycles, the temperature of the refrigerant discharged from the higher compression stage 24 is reduced, improving reliability of the compressor. Thus, performance (efficiency and capacity) of the refrigerant system 20 in both cooling and heating modes of operation is increased and compressor reliability is improved, while the refrigerant system is operating in the heating mode.

The present invention is particularly useful in heat pumps that utilize $CO_2$ as a refrigerant, since the $CO_2$ refrigerant has a high value of a polytropic compression exponent, and high side operating pressures and pressure ratios of such systems can be very high, promoting higher than normal discharge temperatures. Still, the invention would extend to refrigerant systems utilizing other refrigerants.

It should be noted that this invention is not limited to the system shown in the FIG. 1, as the actual refrigerant system may include additional components, such as, for example, a liquid-suction heat exchanger, a reheat coil, an additional intercooler, an economizer heat exchangers or a flash tank. The individual compression stages may include several compressors arranged in tandem. The compressors can be of variable capacity type, including variable speed and multi-speed configurations. Further, the compressors may have various unloading options, including intermediate pressure to suction pressure bypass arrangement, or the compressors may be unloaded internally, as for example, by separating fixed and orbiting scrolls from each on an intermittent basis. These system configurations are also not limited to a particular compressor type and may include scroll compressors, screw compressors (single or multi-rotor configurations), reciprocating compressors (where, for example, some of the cylinders are used as a low compression stage and the other cylinders are used as a high compression stage) and rotary compressors. The refrigerant system may also consist of multiple separate circuits. The present invention would also apply to a broad range of systems, for example, including mobile container, truck-trailer and automotive systems, packaged commercial rooftop units, supermarket installations, residential units, environmental control units, etc.

Although a preferred embodiment of this invention has been disclosed, a worker of ordinary skill in this art would recognize that certain modifications would come within the scope of this invention. For that reason, the following claims should be studied to determine the true scope and content of this invention.

We claim:

1. A heat pump refrigerant system comprising:

a compressor assembly including at least two stages of compression connected in series, with a lower compression stage compressing refrigerant from a suction pressure to an intermediate pressure and passing this refrigerant to a higher compression stage compressing refrigerant from an intermediate pressure to a discharge pressure and with an intercooler positioned intermediate of said lower and higher compression stages;

a switch operable to route refrigerant from said higher compression stage to an outdoor heat exchanger in a cooling mode of operation, and from said higher compression stage to an indoor heat exchanger in a heating mode of operation;

an expansion device positioned intermediate of said indoor and outdoor heat exchangers; and a secondary fluid moving device for moving a secondary fluid over said outdoor heat exchanger, said intercooler being positioned such that it is in the path of the secondary fluid driven by said secondary fluid moving device, with the secondary fluid being moved over the outdoor heat exchanger and the intercooler in both the holing mode and the cooling mode.

2. The heat pump as set forth in claim 1, wherein said intercooler is positioned upstream of said outdoor heat exchanger, in relation to a secondary fluid path.

3. The heat pump as set forth in claim 1, wherein a refrigerant in said heat pump refrigerant system is $CO_2$.

4. The heat pump as set forth in claim 1, wherein the secondary fluid is at least one of air, water and glycol.

5. The heat pump as set forth in claim 1, wherein the secondary fluid moving device is at least one of a fan and a pump.

6. The heat pump as set forth in claim 1, wherein said at least two compression stages are positioned within one compressor.

7. The heat pump as set forth in claim 1, wherein said at least two compression stages are represented by separate compressors.

8. The heat pump as set forth in claim 1, wherein the heat pump refrigerant system operates at least in part in the transcritical cycle.

9. The heat pump as set forth in claim 1, wherein the heat pump refrigerant system operates at least in part in the subcritical cycle.

10. The heat pump as set forth in claim 1, wherein at least one compression stage is an independent compressor.

11. The heat pump as set forth in claim 1, wherein said at least two compression stages include at least one reciprocating compressor.

12. The heat pump as set forth in claim 1, wherein said at least two compression stages include at least one scroll compressor.

13. The heat pump as set forth in claim 1, wherein said switch is a four-way valve.

14. A method of operating a heat pump refrigerant system comprising the steps of:

(1) providing a compressor assembly including at least two stages of compression connected in series, with a lower compression stage compressing refrigerant from a suction pressure to an intermediate pressure and passing this refrigerant to a higher compression stage compressing refrigerant from an intermediate pressure to a discharge pressure and with an intercooler positioned intermediate of said lower and higher compression stages;

(2) providing a switch operable to route refrigerant from said higher compression stage to an outdoor heat exchanger in a cooling mode of operation, and from said higher compression stage to an indoor heat exchanger in a heating mode of operation;

(3) positioning an expansion device intermediate of said indoor and outdoor heat exchangers; and (4) moving secondary fluid over said outdoor heat exchanger, said intercooler being positioned such that it is in the path of the secondary fluid, with the secondary fluid being moved over the outdoor heat exchanger and the intercooler in both the heating mode and the cooling mode.

15. The method as set forth in claim 14, wherein said intercooler is positioned upstream of said outdoor heat exchanger, in relation to a secondary fluid path.

16. The method as set forth in claim 14, wherein a refrigerant in said heat pump refrigerant system is $CO_2$.

17. The method as set forth in claim 14, wherein the secondary fluid is at least one of air, water and glycol.

18. The method as set forth in claim 14, wherein the heat pump refrigerant system operates at least in part in the transcritical cycle.

19. The method as set forth in claim 14, wherein the heat pump refrigerant system operates at least in part in the subcritical cycle.

20. The method as set forth in claim 14, wherein said switch is a four-way valve.

* * * * *